US007062947B2

(12) United States Patent
Farfor

(10) Patent No.: US 7,062,947 B2
(45) Date of Patent: Jun. 20, 2006

(54) CUTTING AND FOLDING MACHINE

(76) Inventor: James Douglas Farfor, 46 Kooyong Road, Armadale, Victoria 3143 (AU)

( * ) Notice: Subject to any disclaimer, the term of this patent is extended or adjusted under 35 U.S.C. 154(b) by 6 days.

(21) Appl. No.: 10/502,002

(22) PCT Filed: Jan. 24, 2003

(86) PCT No.: PCT/AU03/00083

§ 371 (c)(1),
(2), (4) Date: Jul. 19, 2004

(87) PCT Pub. No.: WO03/062110

PCT Pub. Date: Jul. 31, 2003

(65) Prior Publication Data

US 2005/0103082 A1 May 19, 2005

(30) Foreign Application Priority Data

Jan. 24, 2002 (AU) ..... PS 0140
Jul. 26, 2002 (AU) ..... 2002950407

(51) Int. Cl.
*B21D 5/16* (2006.01)
*B21D 33/00* (2006.01)
*B65H 45/28* (2006.01)

(52) U.S. Cl. ..... 72/325; 72/307; 72/294; 132/208

(58) Field of Classification Search ..... 72/326, 72/337, 331, 294, 307, 325; 132/208
See application file for complete search history.

(56) References Cited

U.S. PATENT DOCUMENTS

| | | | | |
|---|---|---|---|---|
| 2,963,066 | A * | 12/1960 | Nelson | 72/294 |
| 2,975,818 | A * | 3/1961 | Rippe | 72/331 |
| 3,156,283 | A * | 11/1964 | Ruschmann | 29/527.4 |
| 3,832,876 | A * | 9/1974 | Arens | 72/11.1 |
| 3,955,515 | A | 5/1976 | Elsas | |
| 3,977,586 | A | 8/1976 | Hertrich | |
| 4,269,130 | A | 5/1981 | Burton et al. | |
| 4,406,251 | A | 9/1983 | Neri et al. | |
| 4,885,896 | A | 12/1989 | Romagnoli | |
| 5,007,443 | A | 4/1991 | Fulgoni | |
| 5,056,539 | A | 10/1991 | Abramson | |
| 5,058,609 | A | 10/1991 | Sandoz et al. | |
| 5,090,591 | A | 2/1992 | Long | |
| 5,335,679 | A | 8/1994 | Baxter | |
| 6,237,608 | B1 * | 5/2001 | Kari | 132/208 |
| 6,602,177 | B1 * | 8/2003 | Muir | 493/424 |

FOREIGN PATENT DOCUMENTS

| | | |
|---|---|---|
| AU | 74242/87 | 12/1987 |
| DE | 298 20 463 U1 | 5/2000 |
| EP | 0 136 982 A1 | 4/1985 |
| WO | WO 95/23535 | 9/1995 |

* cited by examiner

*Primary Examiner*—Daniel C. Crane
(74) *Attorney, Agent, or Firm*—Workman Nydegger

(57) ABSTRACT

A machine for cutting and edge folding foils includes a cutting/folding station. At the cutting/folding station is a folding form about which the foils may be folded. A feeder feeds a length of foil to the cutting and folding station. At the folding station a cutter adjacent to the folding form creates a cut edge in the foil. The path of the cutter is such as to fold the cut edge of the foil around the folding form.

61 Claims, 10 Drawing Sheets

CUTTING AND FOLDING MACHINE

FIELD OF THE INVENTION

This invention relates to machines for cutting foil from a sheet into rectangular pieces with one edge folded over to provide reinforcement along that edge.

BACKGROUND OF THE INVENTION

Rectangular pieces of foil of the above type are used in large numbers in the process of hair colouring in hair salons and the like.

In this process, an individual lock of hair is laid on the foil, and the colouring compound (usually a gel, paste, or viscous liquid) is brushed onto the hair. After applying the colouring compound, the outer end of the foil rectangle is folded up, then sides are folded in, and; so as to make a small pocket or pouch containing the lock of hair and the colouring compound. This process is repeated until all the hair to be coloured is contained in these pockets.

Fifty or so foil rectangles may be used for each head of hair that is coloured. In most cases these foil rectangles are made by hand; a fiddly and time-consuming exercise. Packets of pre-cut foil rectangles are available, but these are seldom used. The foil rectangles are prepared in advance, and are placed in batches in a receptacle at the colourists' workstation. Because the frailty of the foil, the rectangles at the colourists' workstation can become creased and dog-eared, requiring further work before each is used.

It is the object of the invention to provide a machine capable of manufacturing large numbers of foil rectangles at a centralised location, to be distributed to individual workstations as is the present practice. Another objective of at least the preferred embodiment is to produce foil rectangles one at a time on demand at each colourists' work station, so that each rectangle is available in prime condition, not requiring any remedial action by the colourist.

SUMMARY OF THE INVENTION

In one aspect, the invention provides a machine for cutting and edge folding foil, said machine including:

a cutting/folding station including a forming edge about which to fold the foil;

a feeding means for feeding a length of foil to the cutting and folding station; and cutting means to create a cut edge whereby the path of the cutting means is such as to fold the cut edge around the forming edge.

Although the machine is presently intended to produce rectangles from aluminium foil, which may have one or both sides coated with organic film or paint, the machine could also make the rectangles from foils of other metals, paper, treated paper, paper laminated with plastic film or metallic foil, plastic film, or plastic film laminated with metallic foil.

In a preferred form, the cutting means is configured to fold the cut edge under the forming edge. The forming edge may comprise an edge of a plate for supporting the foil as it is fed through the machine.

The machine preferably holds the supported portion of foil under tension. This can be achieved in several ways, as described further below.

The machine preferably also includes means for forming one or more elongate embossments along the length of foil to further reinforce the edge folded foil.

The cutting means preferably includes a serrated blade to reduce the cutting force required to sever the foil portion from the length of foil. The blade is preferably configured to fold the cut edge of the foil under the forming edge as the foil is cut. To this end, the blade is preferably mounted on a rotatable shaft which is biased to return to a rest position clear of the length of foil once the fold has been formed in the cut edge of the foil.

To obtain a higher degree of folding than that achieved by the blade alone, a projection may be provided which extends from the blade on the infeed side of the blade. Preferably, the projection is spaced from the cutting edge of the blade. In a preferred form, the projection is elongate, extending continuously for the full length of the blade. The projection may be in the form of a lobe. In a most preferred form of the invention, the lobe is incorporated into an elongate lobe member having a flat portion lying against the infeed side of the blade with the lobe projecting from the infeed side of the blade. The lobe member may be mounted together with the blade on the rotatable shaft.

The feeding means preferably comprises spaced pairs of rollers between which the foil is fed. One of each pair of rollers is preferably provided with a compressible covering and at least one of each pair of rollers is driven by a suitable drive means. In a particularly preferred form, the other of each pair of rollers is preferably formed with one or more grooves to form the elongate embossment in the foil as it is fed through the machine.

The drive means is preferably an intermittent drive means having a dwell period of a predetermined time to enable the cutting and folding of the foil to be performed while the foil is stationery. Alternatively, the cutting and folding means may be arranged to travel with the foil as it is fed through the machine.

In its simplest form, the drive means is driven by a manual crank, and the dwell period is achieved by a suitably configured cam in the drive mechanism connected to the crank. Alternatively, an electric motor may be used to be providing drive to the drive means.

The foil is preferably taken from a roll which is suitably cradled to allow feeding of the foil from the roll. The cradling means may be provided with a self-alignment means to prevent creasing of the foil as it is fed through the machine.

In accordance with a second aspect of the present invention, there is provided a machine for cutting and edge folding foil, said machine including:

a cutting/folding station including a forming edge about which to fold the foil;

a folding means for feeding a length of foil to the cutting/folding station wherein the feeding means is adapted to dwell for a predetermined dwell period when the foil reaches the cutting/folding station; and cutting means for folding the cut edge about the forming edge, wherein the predetermined time is sufficient for the operation of the cutting means and the means for folding.

In accordance with a third aspect of the present invention, there is provided a method of cutting and edge folding sheet material, said method including:

a) feeding a length of the sheet material to a cutting/folding station which includes a forming edge about which to fold the sheet material;

b) pausing the feed once a predetermined length of the sheet material has been fed;

c) cutting the sheet material to create a cut edge; and d) folding the cut edge about the forming edge wherein the pausing is sufficient for the cutting and folding to occur at the cutting/folding station.

In accordance with a fourth aspect of the present invention, there is provided a method of producing hair colourists' foils, the method including:

loading a roll of colourists' foil into a machine for cutting and edge folding foil;

operating the machine to provide one or more discrete foil sheets, each with a folded edge; and disposing the machine in proximity to the colourist to enable direct access to the foils from the machine.

BRIEF DESCRIPTION OF THE DRAWINGS

In order that the invention may be more readily understood, some preferred embodiments of the invention will now be described with reference to the accompanying drawings, in which.

DESCRIPTION OF PREFERRED EMBODIMENT

Figure 1:
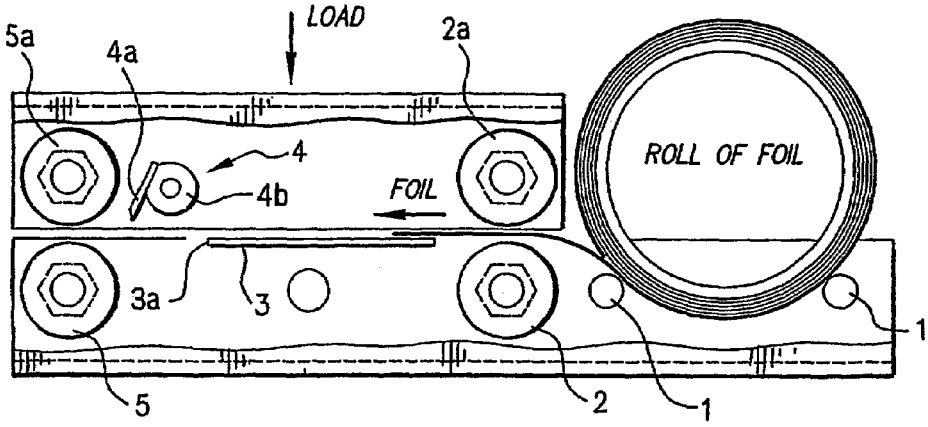
FIG. 1 is schematic side elevation of the machine showing its components in accordance with a first preferred embodiment of the present invention.

Referring firstly to FIG. 1 of the drawings, the cutting and folding machine embodying the invention provides for a roll of foil to be cradled between two rolls 1, from where the foil may be uncoiled into the machine.

The foil passes between two rolls (2) and (2*a*), which are driven intermittently, and which feed the foil into the machine. The intermittent drive causes the infeed rollers to dwell periodically as will be explained in connection with FIG. 2.

The foil next passes over a plate (3) which supports the foil. This plate also provides a forming edge (3*a*), around which the foil is folded during the cutting operation as will be explained. It should be understood that the single plate (3) shown in FIG. 1 is sufficient for operation of the machine in the horizontal orientation shown, and that for operation in other orientations (vertical, upside down, etc.) it may be necessary to provide additional plates to guide the foil through the machine.

After passing over the plate (3), the foil passes under an oscillating cutter blade (4) mounted on a shaft After passing the oscillating cutter blade (4) the foil then passes between two outfeed rolls (5) and (5*a*), which are driven intermittently in synchronisation with the infeed rolls (2) and (2*a*) (the synchronisation of the intermittent motion of infeed and outfeed rolls need not be exact, but sufficient only to allow the cutting and folding operation to take place).

It has been found sufficient to drive one roll only, with the other roll idle and forced against the driven roll. It has also been found advantageous to have one roll with an elastomeric or rubbery surface, in order to accommodate irregularities. In addition, it has also been found advantageous to have an engraved surface on the roll that engages the rubbery roll, in order to emboss the foil longitudinally, and so stiffen it. In the case of the outfeed rolls (5) and (5*a*), the embossing may take the form of written or diagram instructions, or advertising. It has also been found advantageous to drive the outfeed rolls at a slightly higher speed than the infeed rolls and to drive these in a manner that torque is limited (such as a simple belt drive); in this manner any slack is taken up in the foil strip between the infeed and outfeed rolls, but the torque is insufficient to damage the strip.

During the dwell period in the drive of the infeed and outfeed rolls, the strip of foil is held tight between the infeed and outfeed rolls by action of the belt drive connecting the two sets of rolls (it could also be held tight by other means, such as locking the rolls). During the dwell period, and while the foils is so held, the oscillating cutter blade (4) (which is a blade (4*a*) protruding tangentially from a shaft parallel to the infeed and outfeed rolls) is then rotated so as to pierce and cut the strip of foil, and continues to rotate so as to fold the end of foil on the infeed roll side over the edge of the edge (3*a*) of the plate (3). After reaching an extreme position at which the foil is folded under the plate, the cutter blade (4) returns to a position that is removed from the path of foil through the machine, before the intermittent drive to the foil is resumed. It has been found advantageous that the cutter blade should have a serrated cutting edge, in order to reduce cutting forces.

After the cutting and folding operation of the oscillating blade (4), the intermittent drive of the feed rolls is resumed. The infeed rolls move the strip of foil forward so that the folded edge moves forward from the edge of the plate (3*a*). The folded end of the strip continues to move forward to be caught between the outfeed rolls. The outfeed rolls compress the folded edge to a tightly folded configuration, and drive the strip forward at a higher speed than the infeed rolls, removing any slack from the strip, until the dwell period in the feed is reached. The trailing edge of the piece of foil is cut during the next cutting stroke which also forms the folded edge of the subsequent pieces of foil and so on. The outfeed rolls discharge the cut piece of foil.

Figure 3:
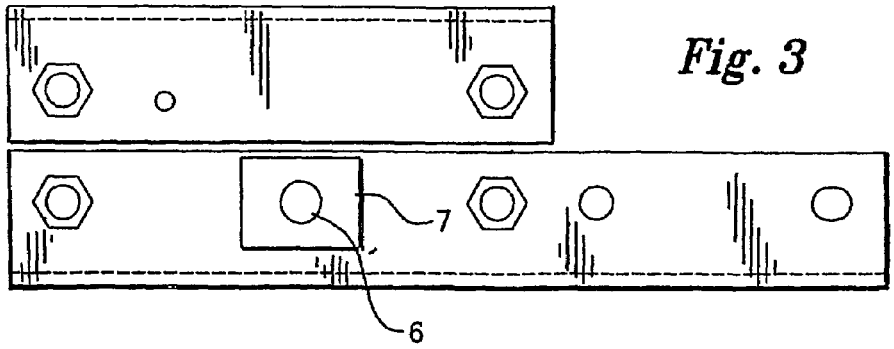
FIG. 3 is a side elevation of the near side of the machine showing the motor or crank mechanism of the drive means.
Figure 5:
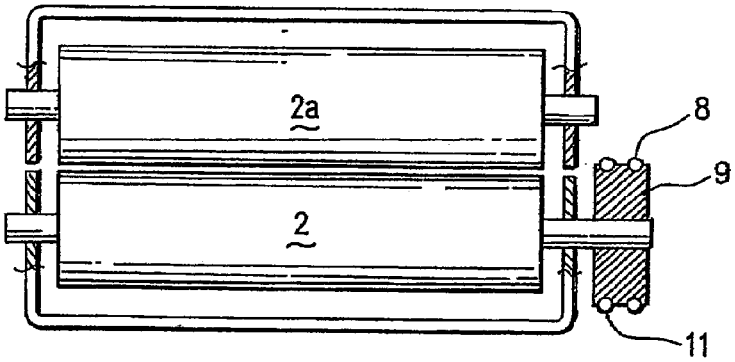
FIGS. 5 and 6 are sectional end elevations along the lines 5—5 and 6—6, further detailing the drive mechanism and feeding means.
Figure 6:
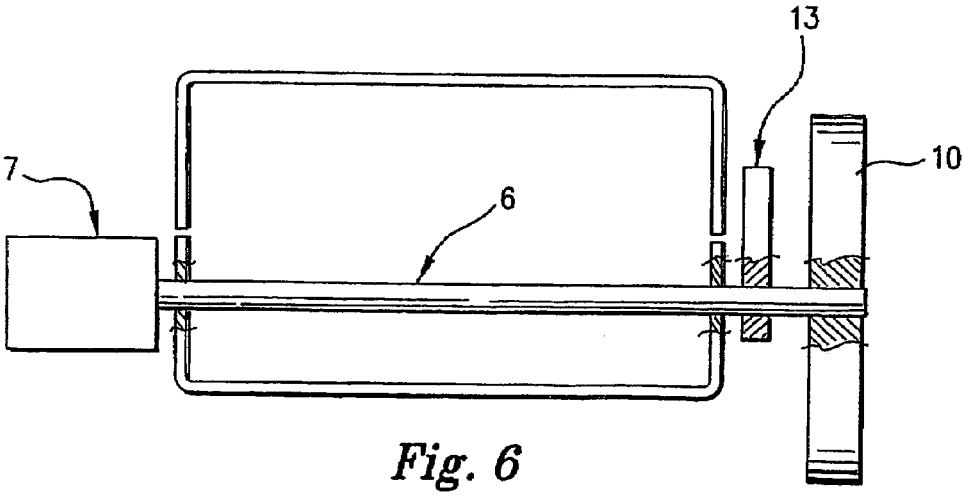

Referring to FIGS. 3, 5 and 6, a convenient arrangement of the machine is shown in which the rolls (2), (2*a*), (5) and (5*a*) are held in two U shaped frames. A drive shaft (6) passes through one frame. This allows the shaft to be driven at one side of the machine by hand crank or electric motor (7). At the other end of the shaft (6) are components that provide the intermittent drive to the feed rolls, and actuate the oscillating cutter.

Figure 4:
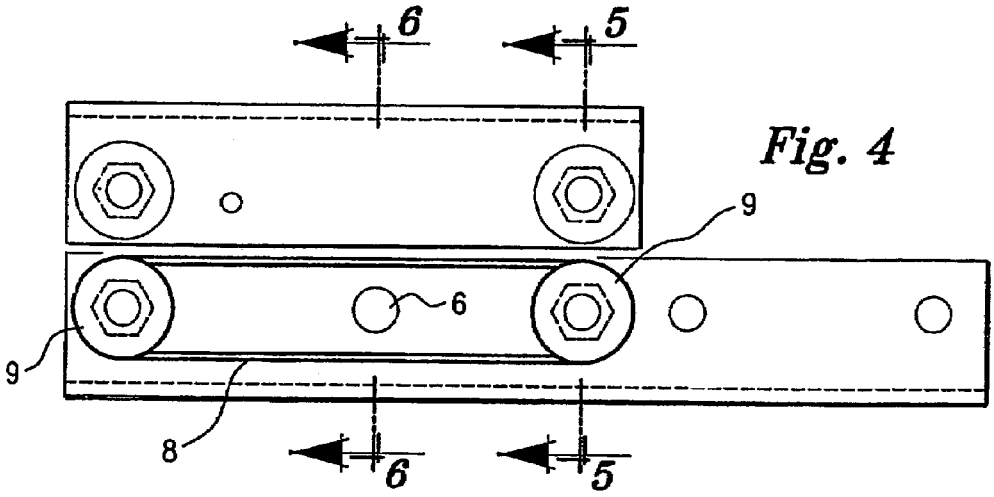
FIG. 4 is a side elevation illustrating the drive for the feed rollers.

The outermost drive components provide a belt drive (FIGS. 4 and 5) between the infeed and outfeed rolls. It has been found sufficient to use an elastomer O-ring (8) running in sheaves (9) attached to the feed rolls for this purpose. The difference in speed of the infeed and outfeed rolls is achieved by differing the diameters of the sheaves.

Figure 2:
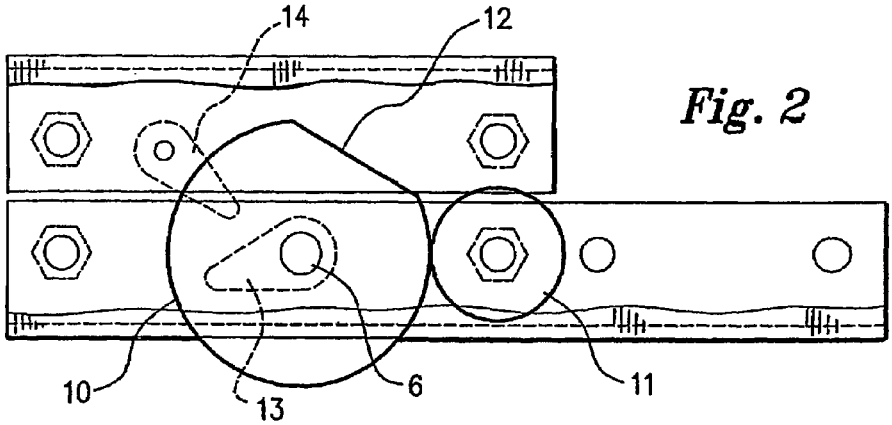
FIG. 2 is a side elevation of the far side of the machine of FIG. 1 showing the drive mechanism.

As shown in FIGS. 2 and 3, the drive components located inboard of the belt drive 8 provide the intermittent motion to the rolls. A drive wheel (10) is driven by shaft (6), drives an O-ring (11) on the sheave (9) attached to the infeed roll for this purpose. By cutting away a section (12) of the drive wheel (10), the drive to the feed rolls is disengaged during a part of the rotation of the drive wheel, and an intermittent drive to the feed rolls (2, 2*a*) is provided.

The drive components located in the extreme inboard position provide the oscillating motion to the cutter blade. It has been found sufficient to oscillate the blade by means of a cam (13) which operates on a follower (14) attached to the cutter shaft during the dwell period of the feed roll drive. Alternatively, cam (13) may be replaced by a roller on wheel (10) and follower (14) may be in the form of an arm attached to the cutter shaft.

Figure 7:
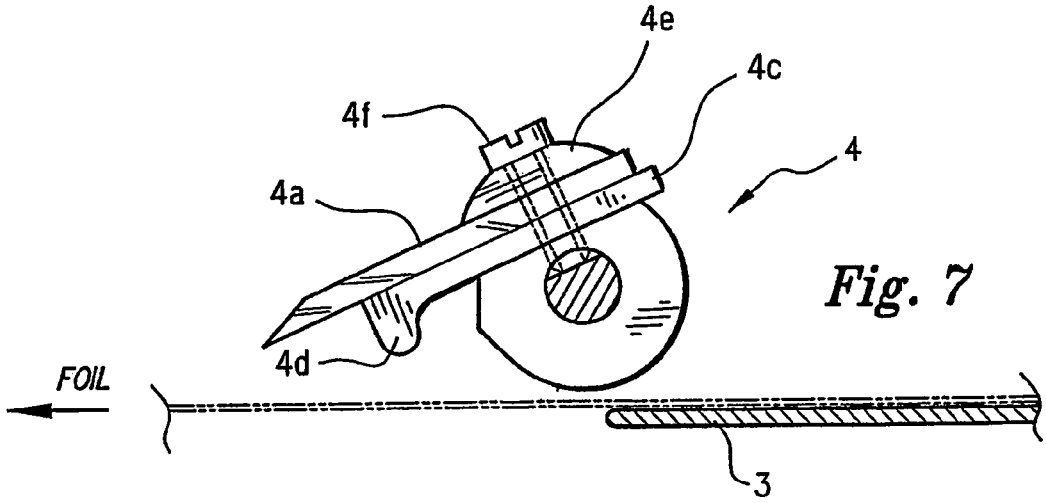
FIG. 7 is a detailed schematic side view of a second preferred embodiment illustrating a modified cutter in a first position.
Figure 8:
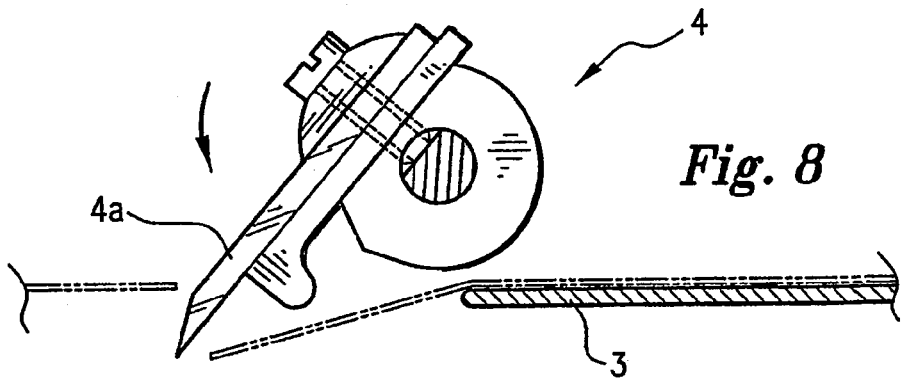
FIG. 8 is detailed schematic side view of the cutter of FIG. 7 shown in a second position cutting the foil.
Figure 9:
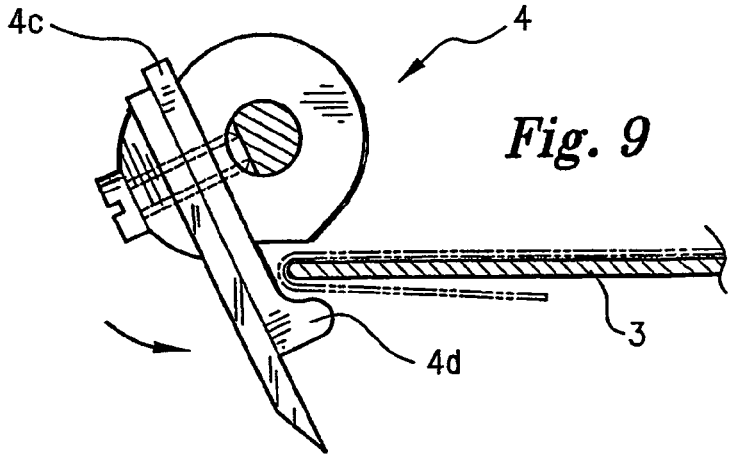
FIG. 9 is detailed schematic side view of the cutter of FIG. 7 at the extreme end of the cutting stroke.

FIG. 7 to 9 show a modified form of the cutter (4). The cutter (4) includes the rotatable shaft (4*b*) and a cutting blade (4*a*) as per the previous embodiment. The rotatable shaft (4*b*) may be an elongate hexagonal rod (not shown) and thus the cutting blade (4*a*) can be fixed against one of the flat sides of the hexagonal rod. Alternatively, the rotatable shaft may comprise a cylindrical roller with a flat machined thereon to mount the blade tangentially. The cutting blade (4*a*) is clamped by an elongate crescent shaped extrusion (4*e*) and fastened by fastener (4*f*). The hexagonal rod (4*b*) has a travel of approximately 90 degrees from the position illustrated in FIG. 7 to the extreme position illustrated in FIG. 9.

The embodiment of FIGS. 7 to 9 includes a elongate lobe member (4*c*) which lies between the cutting blade (4*a*) and the hexagonal rod (4*b*). The lobe member (4*c*) comprises a flat portion which lies flat against the cutting blade (4*a*) and a lobe portion (4*d*) which projects from the blade. The lobe portion (4*d*) projects towards the infeed side of the foil and is spaced from the cutting edge of the blade (4*a*).

FIG. 8 illustrates the cutting of the foil at the cutting edge of the blade (4*a*). As the cutter (4) continues in its path of rotation from the position shown in FIG. 8 to that of FIG. 9, the foil will come in contact with the infeed side of the blade (4*a*) and be folded downwardly towards the underside of the plate (3). At some point, the lobe portion (4*d*) will contact the foil enabling a more acute fold to be achieved than if the lobe portion (4*d*) were not present. The cutter (4) then returns to the position illustrated in FIG. 7 and the process continues as described in connection with the first embodiment The lobe portion (4*d*) is configured such that it does not touch the underside of the plate 3 in the extreme position of the cutter (4) illustrated in FIG. 9. It is preferred that there is separation of at least 0.25 mm. Otherwise, the lobe portion (4*d*) could unintentionally cut the foil. In another preferred embodiment, there may be two projecting lobe portions such that in the extreme position of FIG. 9, one lobe portion is disposed on the underside of plate (3) and another is disposed in the region slightly above the plate (3) to form a crisp edge on the foil.

Figure 10:
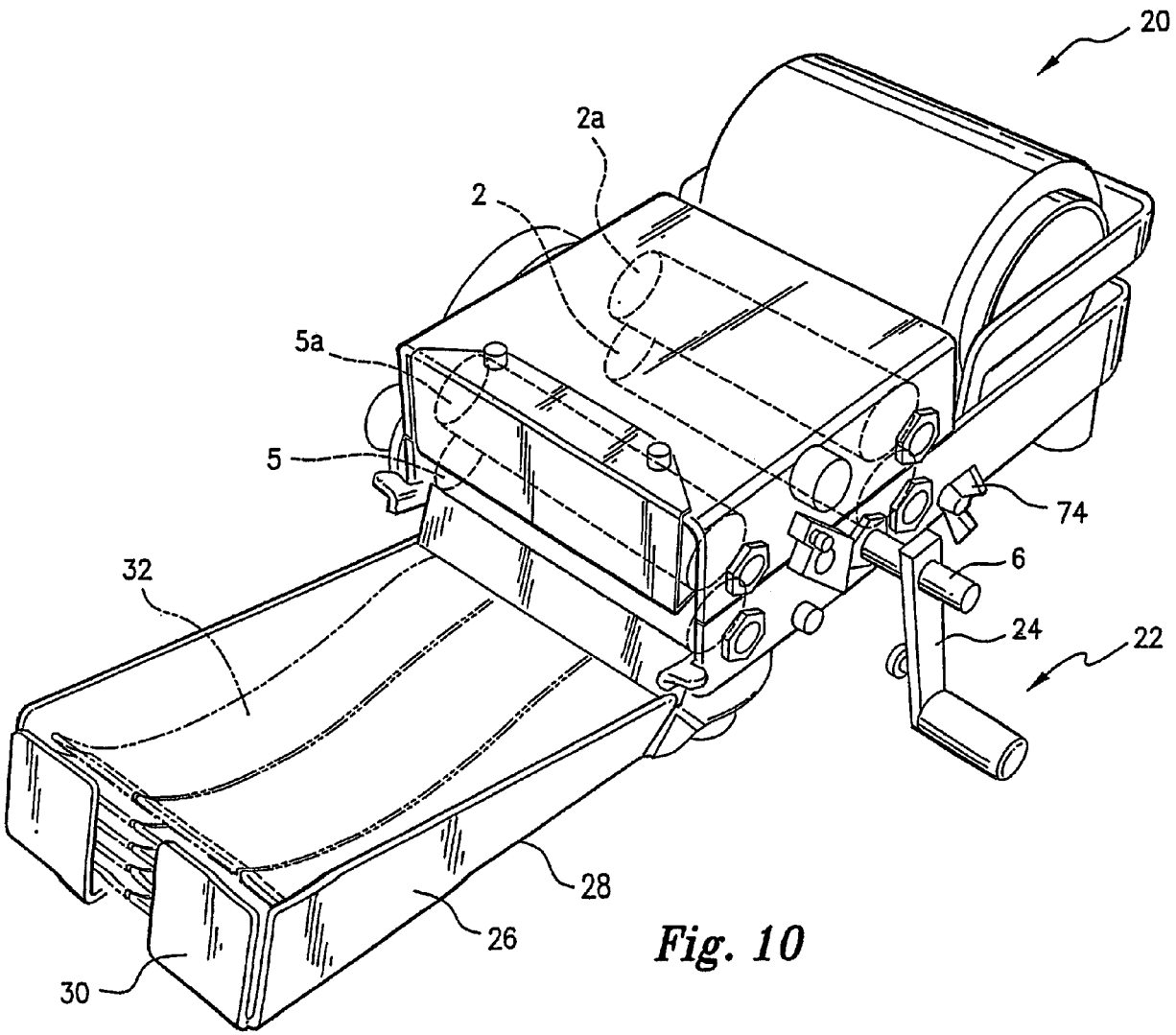
FIG. 10 is a perspective view of a third preferred embodiment of the present invention.

FIGS. 10 to 21 illustrate a third preferred embodiment of present invention. Some of the components are similar to those illustrated in the first and second embodiments and like numerals will be used to represent like parts. FIG. 10 illustrates the overall machine (20) according to the third preferred embodiment The feed rollers (2), (2*a*), (5), (5*a*) are illustrated in phantom to give an indication as to the location of the rollers within the machine (20). In the third preferred embodiment, the pair of infeed rollers is located closer to the pair of outfeed rollers than in the first preferred embodiment. This reduces the likelihood of crumbling and buckling of the foil. FIG. 10 illustrates a handle (22) which drives a crank arm (24) to rotate drive shaft (6).

The machine (20) also has a detachable tray (26) which has a downwardly inclined base (28) and an end stop (30) and thereby produces a neat stack of completed foils (32).

In this embodiment, the coil cradle is modified to improve tracking of the foil strip. The coil cradle (not shown) comprises an upturned U-section. The two ends of the U-section have cut outs to cradle the ends of the foil roll. The base of the U-section is loosely attached to the base of the housing through a pivot point which allows the coil to align with the direction of uncoiling.

Figure 11:
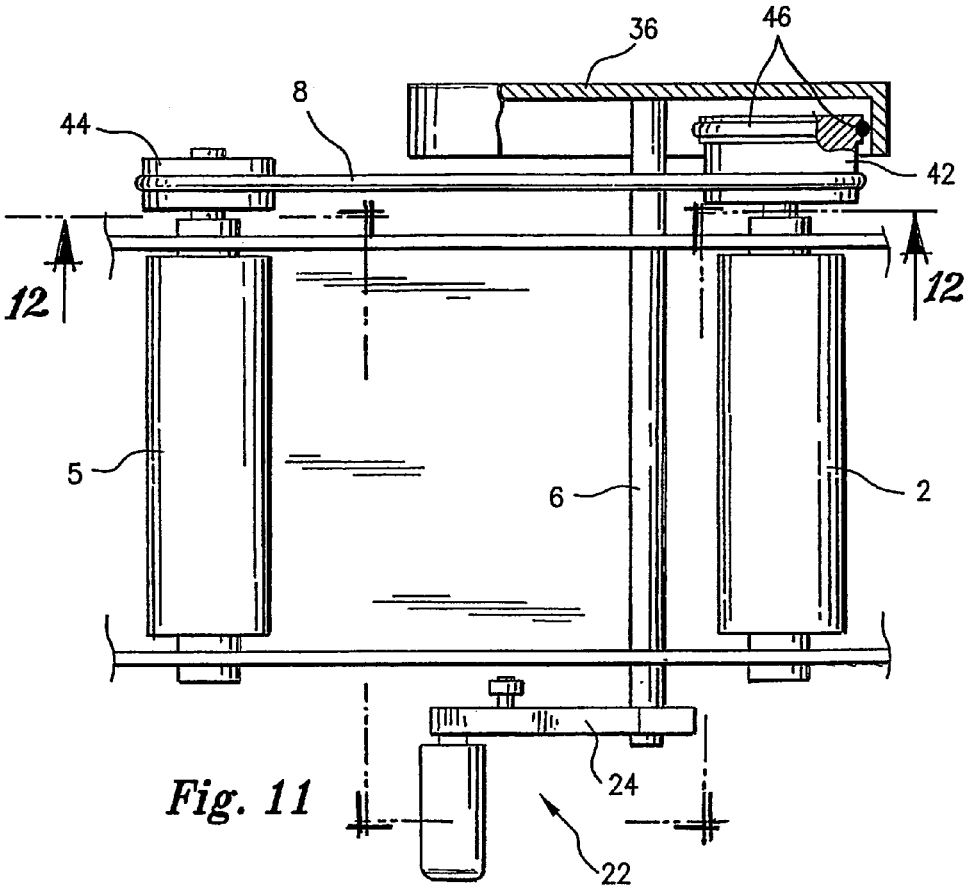
FIG. 11 is a top view of the drive mechanism of the machine illustrated in FIG. 10.
Figure 14:
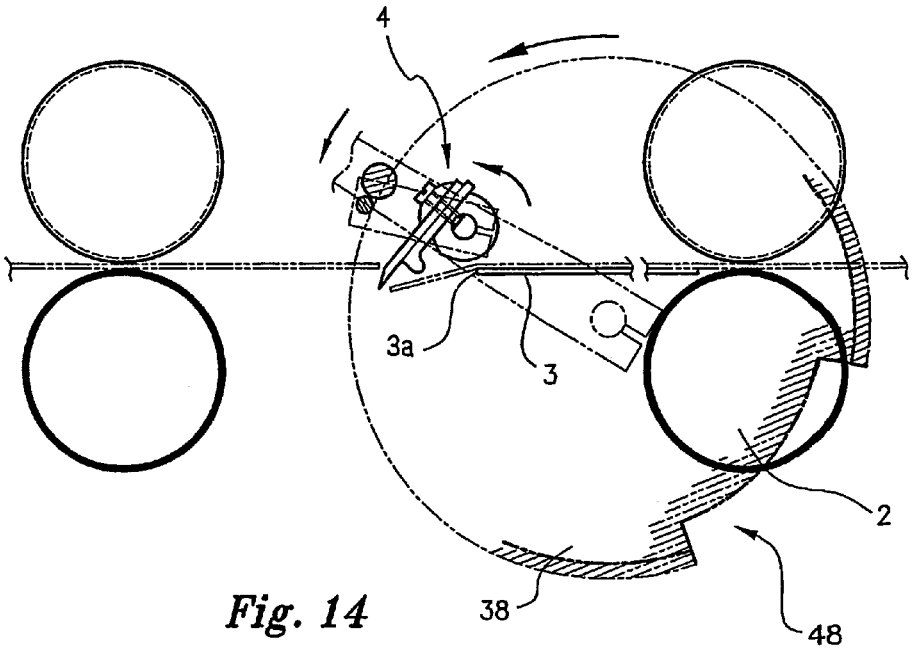
FIG. 14 is a side view as in FIG. 13, except during the cutting stroke.
Figure 15:
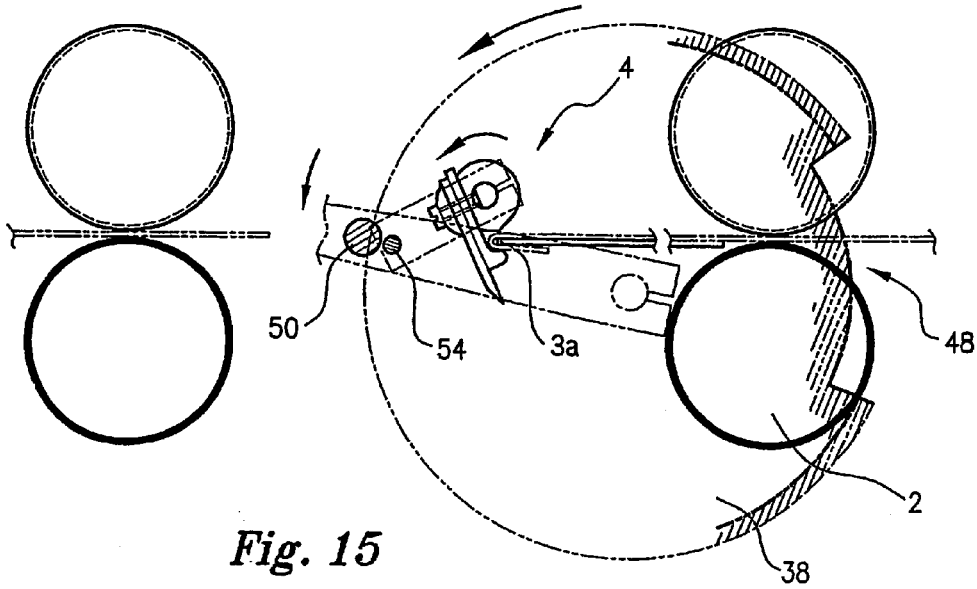
FIG. 15 is a side view as in FIG. 13, except at the end of the cutting stroke.

FIG. 11 illustrates the drive mechanism for the machine (30) of FIG. 10. As already mentioned, the drive mechanism includes handle (22) which rotates crank arm (24) on end of drive shaft (6). The drive shaft (6) extends transversely across the machine (20) to the other side. A drive wheel (36) is connected to the opposite end of the drive shaft (6) to that to which the handle (22) is attached. The drive wheel (36) which can be seen in FIGS. 11 and 12 comprises a substantially circular plate like portion (38) and a discontinuous outer rim (40). Disposed at the end of the lower infeed roller (2) is a sheave (42) having two peripheral grooves. Located at the corresponding end of the lower outfeed roller (5) is a sheave (44) having a single circumferential groove. A drive belt (8) runs between infeed sheave (42) and the outfeed sheave (44). An elastomeric ring (46) resides within the other circumferential groove of infeed sheave (42). This elastomeric ring increases the frictional contact between the infeed sheave (42) and the inner cylindrical surface of the rim (40). As will be appreciated from a consideration of FIGS. 11 and 12, as the drive wheel 36 rotates, the inner cylindrical surface of the rim (40) will drive the sheave (42) which in turn drives the outfeed sheave (44). However, as already explained, the rim (40) has a discontinuity (48) formed therein. When the orientation of the drive wheel (38) corresponds with the discontinuity (48) lying in the region of the sheave (42), the sheave (42) will not be driven by the drive wheel (38). See for example the relative positions of the infeed roller (2) and the drive wheel (38) as illustrated in FIGS. 14 and 15. Thus, the drive to the lower infeed roller (2) will be intermittent and accordingly, the drive to the outfeed roller (5) will likewise be intermittent.

Figure 12:
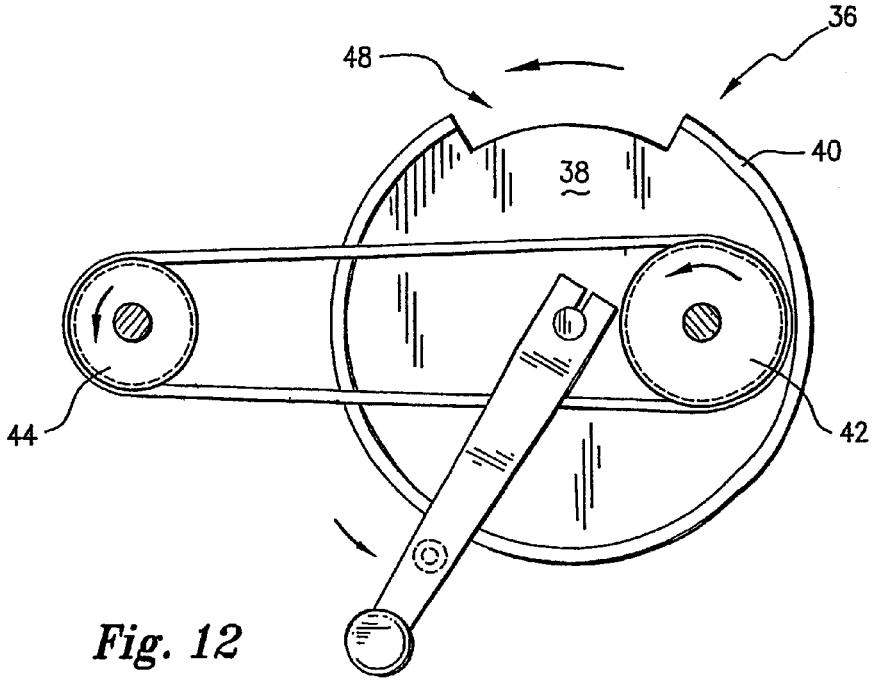
FIG. 12 is a side view of the drive mechanism of FIG. 11.

FIG. 12 illustrates that the sheave (44) is of lesser diameter to sheave (42). The outfeed roller (5) will therefore run at a slightly higher speed to take up any slack in the foil strip between the infeed and outfeed rollers.

Figure 13:
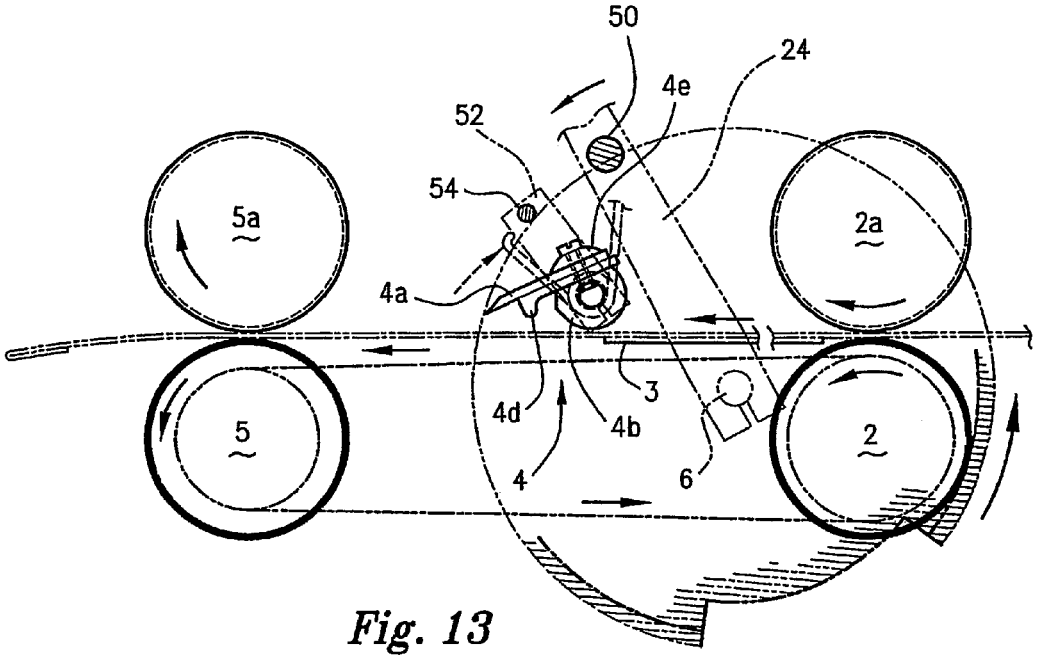
FIG. 13 is a side view of certain components of the machine of FIG. 10 illustrating the cutter at the at rest position prior to the commencement of the cutting stroke.

In the third embodiment, the traverse of foil through the various roller sets and the cutting/folding station to produce the completed foils (32) is substantially the same as that described in connection with the first embodiment as modified by the cutting means of the second embodiment. FIGS. 13 to 16 illustrate the timing of the cutting stroke in relation to the dwell period in the drive of the rollers (2), (2*a*), (5), (5*a*). Referring to FIGS. 13 and 17 in conjunction, it can be seen that the crank arm (24) of handle (22) is provided with a first projecting roller (50). The roller (50) travels in a circular path with the winding of crank handle (22). In the preferred embodiment, the axis of the handle (22) and drive shaft (6) is coplanar with the axis of lower rollers (2), (5). However, for the convenience of illustration, this is not depicted in the drawings. Alternatively the projecting roller may be provided in an auxiliary crank arm (not shown) rotatably mounted to the drive shaft (6) wherein the auxiliary crank arm is disposed inside a safety cover (not shown) with the handle (22) disposed externally of the safety cover.

As already explained in connection with FIGS. 7 to 9, the cutter (4) rotates about the axis of a transversely extending elongate rod (4*b*). An actuator (52) is connected to the rod (4*b*) to pivot therewith and lies outwardly of the machine housing as depicted in FIG. 17. The actuator 52 has an outwardly extending cylindrical projection (54) as can been in FIGS. 17 and 13. The projection (54) rotates in an arc about the axis of rod (4*b*). It will be appreciated that the radius of this arc is smaller than that of the circular path of the projecting roller (50).

FIG. 13 illustrates the relative positions of the components just prior to the beginning of the dwell period. At the beginning of the dwell period, the projecting roller 50 is approaching the projection (54). At some point during the dwell period the projecting roller (50) contacts the projection (54) and the cutter (4) is caused to rotate in a manner illustrated in FIG. 14. As already explained, the arc travelled by the projection (54) has a smaller radius of curvature than the circular path of the projecting roller (52) and prior to the end of the dwell period, the projecting roller (50) passes over the projection (54) in the manner illustrated in FIG. 15. At this point, the leading end of the foil has been folded around the forming edge (3*a*) as shown.

Figure 16:
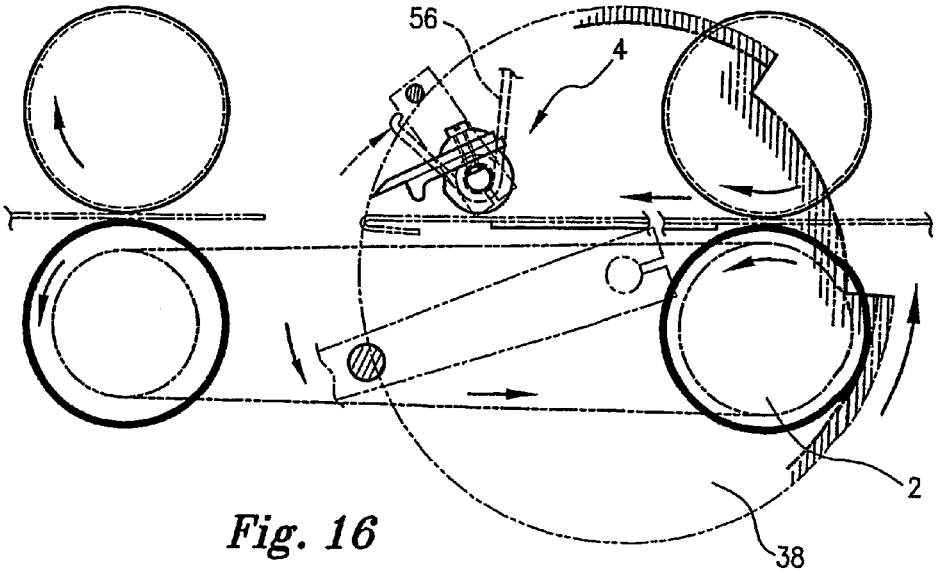
FIG. 16 is a side view as in FIG. 13 except returned to the at rest position.
Figure 17:
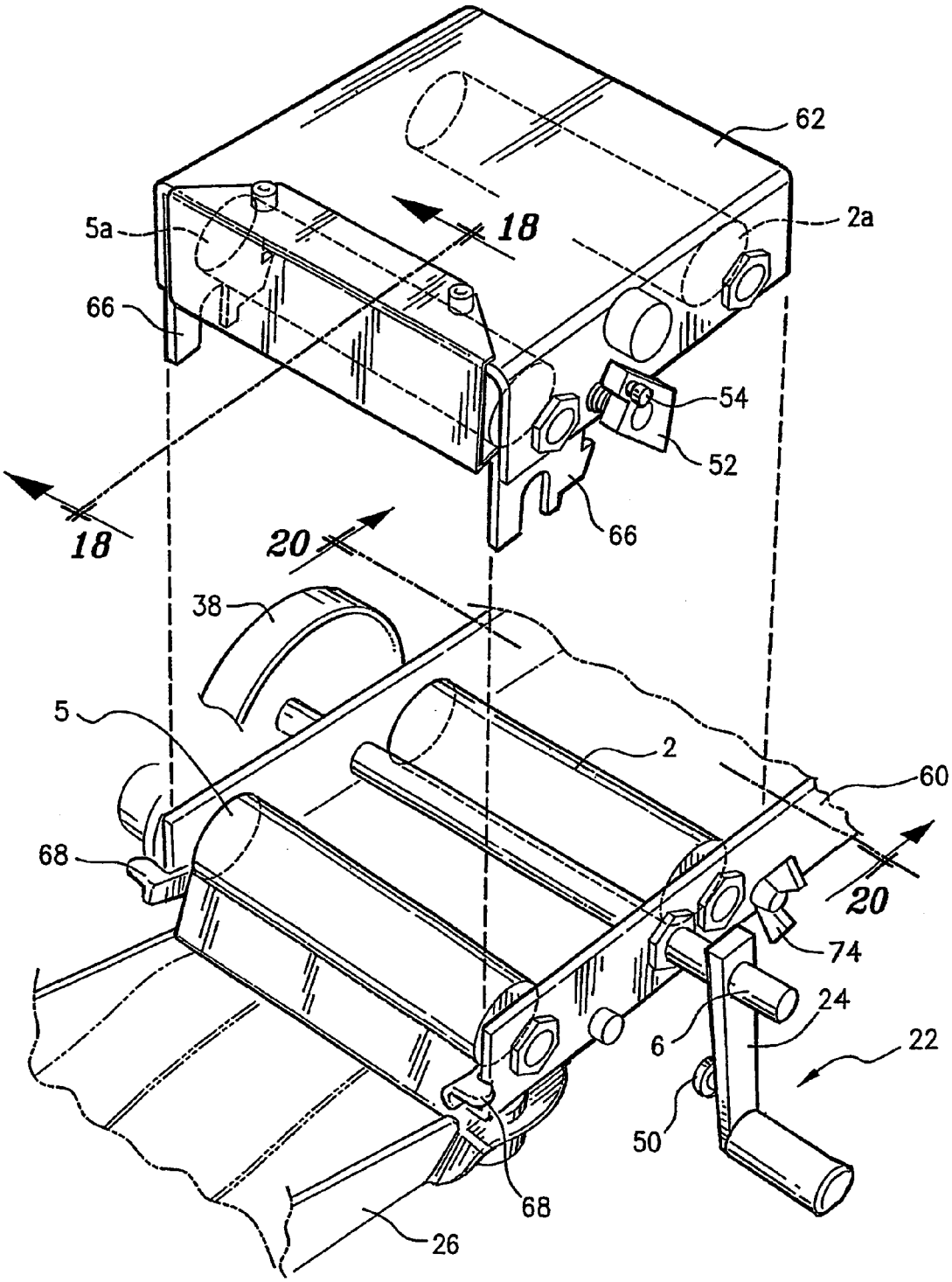
FIG. 17 is an exploded perspective view of a portion of the machine illustrated in FIG. 10.

FIG. 16 also depicts a spring (56) which operates to bias the cutter (4) to the at rest position illustrated in FIG. 16. The arrangement of the spring can also be ascertained from an inspection of FIG. 19.

As already mentioned, once the drive wheel (38) has rotated to the position illustrated in FIG. 16, the drive wheel (38) will drive the lower infeed roller (2) and the foil will continue in its traverse through the machine.

FIG. 17 illustrates that the housing may be made up of a lower housing portion (60) and an upper housing portion (62). The lower housing portion (60) mounts the lower rollers (2), (5), the drive mechanism including drive shaft (6), drive wheel (38) and so on. The upper housing portion (62) mounts the upper rollers (2*a*), (5*a*) together with the cutter (4). The upper housing portion (62) includes two dependent mounts (66) on either side. These dependent mounts (66) receive cylindrical bearing portions on the ends of lower outfeed roller (5). The housing also incorporates latches to lock the upper housing portion (62) to the lower housing portion (60). These latches are operated by levers (68) on the forward end of the lower housing portion (60).

Figure 18:
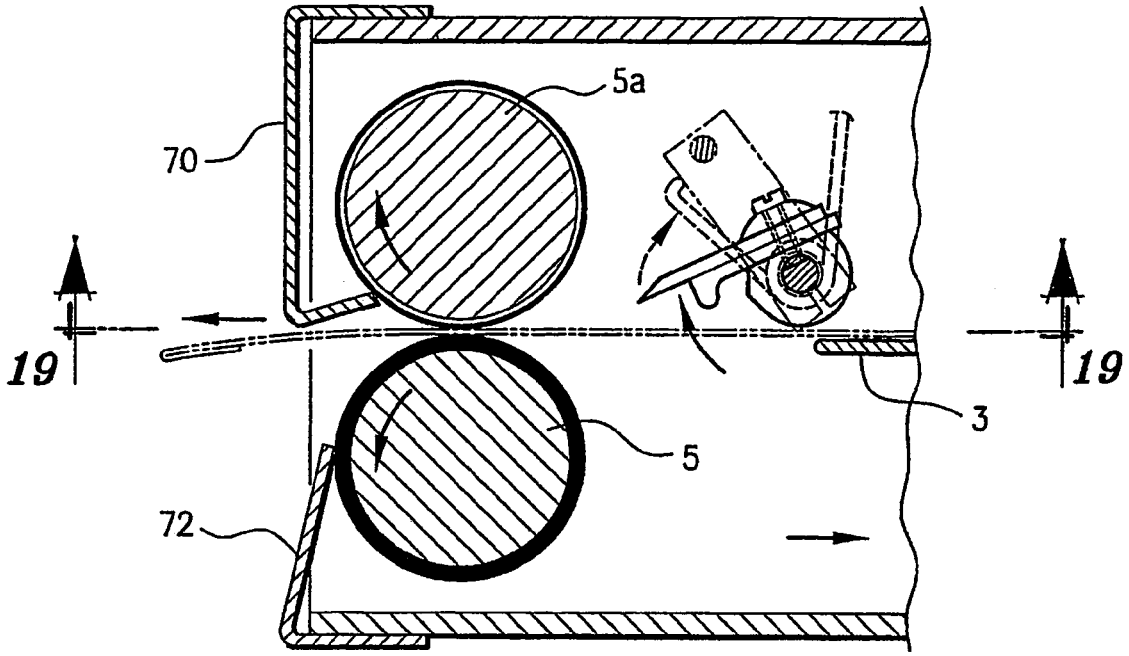
FIG. 18 is a part cross-sectional view of a forward end of the machine.

FIG. 18 illustrates upper and lower guards (70), (72). The upper guard (70) reduce the tendency for the foils to curl as they are discharged from the outfeed rollers (5), (5*a*). The lower guard (72) prevents the discharging foils from being drawn underneath the mechanism.

Figure 19:
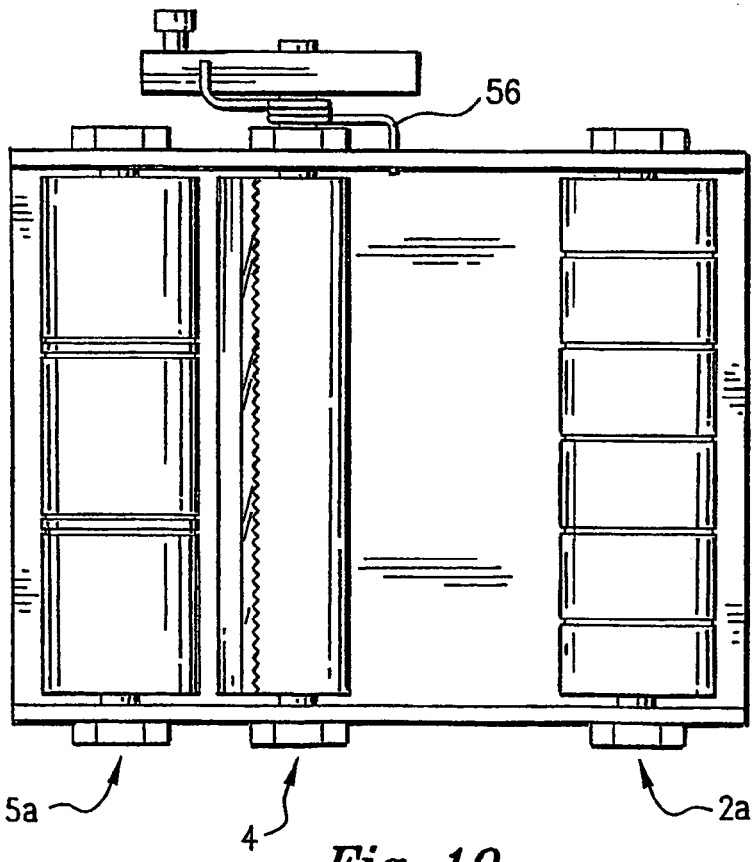
FIG. 19 is a view of the underside of the upper housing portion illustrated in FIG. 17.

FIG. 19 illustrates the arrangement of grooves formed in the upper infeed and outfeed rollers (2*a*), (5*a*). As shown, the infeed roller (2*a*) has five equally spaced circumferential grooves to impart additional stiffness to the foil. This ensures that the foil has enough stiffness to traverse to the outfeed rollers. Additionally, as shown, the upper outfeed roller (5*a*) has two spaced pairs of circumferential grooves. These grooves assist to improve outfeeding of the foil since it has been found that some types of foil tend to curl or feed out in an irregular manner so as not to create a neat stack in the output tray.

In particular, the spacing of the grooves in the upper outfeed roller (5*a*) is such that each of the grooves within each pair is closely spaced so as to form two double grooves. This facilitates folding of the foils in use by the colourist. The foils may thus be end folded prior to side folding. Alternatively, the side folding maybe effected prior to end folding and the double grooves provide sufficient flexibility to do either.

An additional feature of the preferred embodiment of the invention is to provide a non-stick coating (eg. telfon) on the support plate (3). In particular, telfon with carbon fibre acts to discharge electricity to avoid static build-up.

Figure 20:
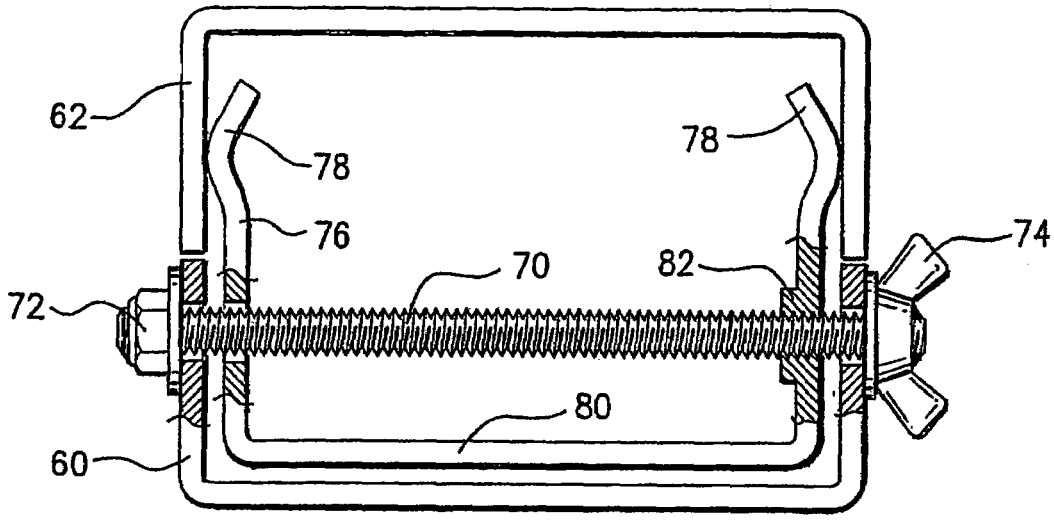
FIG. 20 is a transverse sectional view through 20—20 of FIG. 17.
Figure 21:
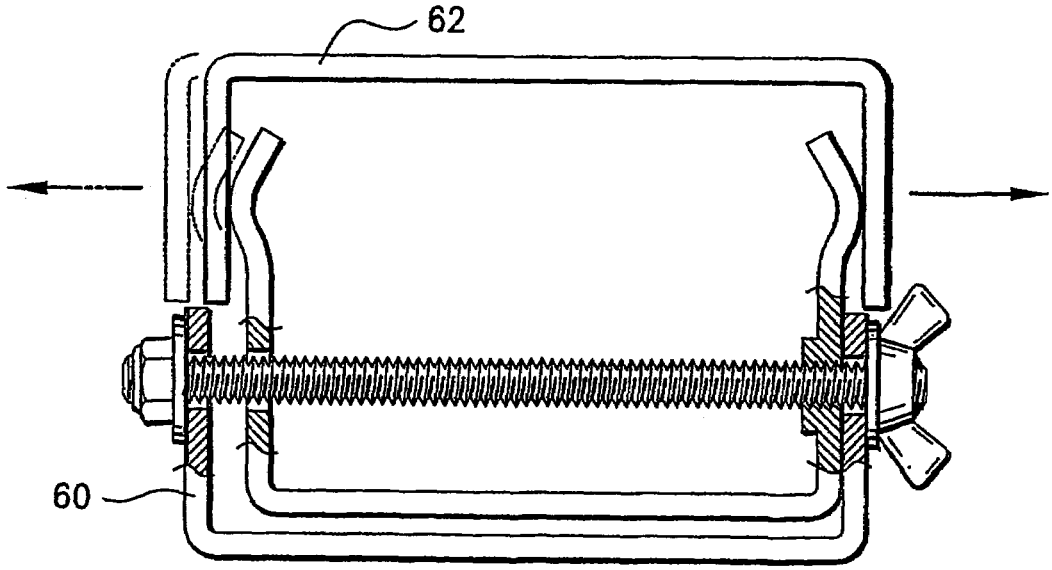
FIG. 21 is a schematic view corresponding to FIG. 20.

FIGS. 20 and 21 attempt to resolve a difficulty presented by a commonly encountered problem whereby the foil rolls are rolled with uneven tension across the width of the roll. This problem can create crinkles in the finished foils.

An adjustment device for alleviating this problem is illustrated in FIGS. 20 and 21. The adjustment device comprises a threaded rod (70) extending beyond the sidewalls of the lower housing portion (60). The rod (70) is disposed forward of the infeed rollers (2, 2*a*). The threaded rod (70) has a captive nut (72) deposed at one end and an adjustable wingnut (74) threadingly engaged with the other end. The threaded rod (70) passes through the side walls of the lower housing portion (60) with sufficient clearance to permit the rod (70) to freely rotate.

Mounted on the threaded rod (70) is a shifting device (76) which comprises an upturned U-shaped strap member (76). The strap member (76) has two upstanding arms (78) and a transversely extending web (80). The threaded rod (70) passes through each of the upstanding arms (78). One of the upstanding arms (78) has a threaded hole (82) which threadingly engages with the threaded rod (70). The other upstanding arm (78) has sufficient clearance to enable the threaded rod to pass therethrough.

It will be appreciated that rotation of the wingnut will cause transverse movement of the shifting device (76). The upstanding arms (78) bear against the inside of the side walls of the upper housing portion (62). Depending upon the position of the adjustment device on the threaded rod (70), the rear end of the upper housing portion (62) will be caused to twist. By this means, the adjustment of the wingnut (74) can be used to bring about adjustment which alleviates the problem of crinkles being created in the finished foils.

Since modifications within the spirit and scope of the invention may be readily effected by persons skilled in the art, it is to be understood that the invention is not limited to the particular embodiment described, by way of example, hereinabove.

The invention claimed is:

1. A machine for cutting arid edge folding foil, said machine comprising:

means for feeding and holding a length of foil, the means for feeding and holding including means for infeeding the foil and means for outfeeding the foil;

a cutting/folding station positioned between and spaced from the means for infeeding the foil and the means for outfeeding the foil, the cutting/folding station including means for cutting the foil and a forming edge about which to fold the foil;

said means for cutting the foil being movable along a path spaced from the forming edge to pierce a side of the foil to create a cut edge at a location of the foil in which the other side of the foil is unsupported as the foil is held by the means for infeeding and the means for outfeeding and to fold the cut edge around the forming edge.

2. The machine as claimed in claim 1 wherein the means for cutting comprises a serrated blade.

3. The machine as claimed in claim 1 wherein the path of the means for cutting is and arcuate path extending at least between a position forwardly of the forming edge on one side thereof to a position at least partly on the other side of the forming edge.

4. The machine as claimed in claim 1 wherein the means for cutting comprises a transversely extending blade which is pivotably mounted.

5. The machine as claimed in claim 4 further comprising a projection extending from the blade on the infeed side of the blade.

6. The machine as claimed in claim 5 wherein the projection is spaced from the cutting edge of the blade.

7. The machine as claimed in claim 5 wherein the projection is elongate, extending continuously for substantially the transverse length of the blade.

8. The machine as claimed in claim 1 wherein the forming edge comprises a leading edge of a means for support upon which a predetermined portion of the length of foil is supported as the cut edge is folded around the forming edge.

9. The machine as claimed in claim 8 wherein the means for support comprises a plate.

10. The machine as claimed in claim 1 wherein the means for infeeding comprises a pair of infeed rollers.

11. The machine as claimed in claim 10 wherein one of the infeed rollers has a compressible covering.

12. The machine as claimed in claim 11 wherein the other of the infeed rollers has means for forming one or more embossments along the length of foil.

13. The machine as claimed in claim 12 wherein the other roller has circumferential ridges or grooves to form stiffening grooves or ridges in the foil.

14. The machine as claimed in claim 1 wherein the means for feeding is adapted to dwell for a predetermined dwell period when the foil reaches the cutting/folding station.

15. The machine as claimed in claim 14 wherein the dwell period is sufficiently long to enable the cutting and folding to be performed.

16. The machine as claimed in claim 14 further including a means for driving which is operably connected to the means for feeding by a drive mechanism wherein the drive mechanism is such that the drive is temporarily suspended for the dwell period causing the means for feeding to dwell for the predetermined time.

17. The machine as claimed in claim 16 wherein the drive mechanism incorporates a cam.

18. The machine as claimed in claim 16 wherein the drive mechanism includes two frictionally engaging cylindrical surfaces, one of which is discontinuous so as to cause interruption of the drive to the other cylindrical surface.

19. The machine as claimed in claim 18 wherein both of the cylindrical surfaces are external surfaces.

20. The machine as claimed in claim 18 wherein a first one of the cylindrical surfaces is external and the second one is formed internally of a wheel having an outer rim which is discontinuous.

21. The machine as claimed in claim 16 wherein the means for driving is operably connected to the means for cutting.

22. The machine as claimed in claim 1 further including means for driving having at least one rotating member, wherein one of the rotating members is provided with a first projection co-operable with the means for cutting such that with each rotation of the rotating member, the means for cutting is actuated.

23. The machine as claimed in claim 22 wherein the means for cutting is pivoted to effect a cutting stroke and the means for driving incorporates a crank arm having said first projection and the means for cutting has a pivotable actuator having a second projection which is engaged by the first projection during a predetermined portion of the rotational path of the crank arm to actuate the actuator and pivot the cutting means.

24. The machine as claimed in claim 23 wherein the means for cutting is biased to return after the cutting stroke.

25. The machine as claimed in claim 16 wherein the means for driving includes a motor.

26. The machine as claimed in claim 16 wherein the means for driving includes a manually operable crank handle.

27. The machine as claimed in claim 16 wherein the means for outfeeding comprises a pair of outfeed rollers downstream of the cutting/folding station and wherein the outfeed rollers are driven at a faster rate than the means for infeeding.

28. The machine as claimed in claim 27 wherein the outfeed rollers are driven from the means for infeeding to incur the dwell for the predetermined dwell period.

29. The machine as claimed in claim 27 wherein one of the outfeed rollers has a compressible covering.

30. The machine as claimed in claim 27 wherein the other of the outfeed rollers has circumferential ridges or grooves to form stiffening grooves or ridges in the foil, the ridges or grooves being arranged in spaced pairs to facilitate folding by the colourist.

31. The machine as claimed in claim 10 wherein the means for outfeeding comprises a pair of outfeed rollers and wherein the infeed rollers comprise first and second infeed rollers and the outfeed rollers comprise first and second outfeed rollers, the first infeed and outfeed rollers being mounted within a first housing portion and the second infeed and outfeed rollers being mounted within a second housing portion, the first housing portion being selectively separable from the second housing portion.

32. The machine as claimed in claim 31 further including means for adjustment to twist the first housing portion relative to the second housing portion.

33. The machine as claimed in claim 31 further including a cradle which is pivotally mounted to the base of the second housing portion, the cradle being used to support a roll of foil.

34. A method of producing hair colourists' foils, the method comprising:

loading a roll of colourists' foil into a machine for cutting and edge folding foil;

operating the machine to provide one or more discrete foil sheets, each with a folded edge, the machine being manually driven by a rotatable crank handle; and disposing the machine in proximity to the colourist to enable direct access to the foils from the machine.

35. The method as claimed in claim 34 wherein the colourist loads and operates the machine.

36. A machine for cutting and edge folding foil, said machine comprising:

a pair of infeed rollers and a pair of outfeed rollers spaced from the pair of infeed rollers, between which a length of foil can be fed;

a cutting/folding station positioned between and spaced from the pair of infeed rollers and the pair of outfeed rollers, the cutting/folding station including a cutter and a forming edge about which to fold the foil;

said cutter being movable along a path spaced from the forming edge to pierce a side of the foil to create a cut edge at a location of the foil in which the other side of the foil is unsupported as the foil is held by the pair of infeed rollers and the pair of outfeed rollers and to fold the cut edge around the forming edge.

37. The machine as claimed in claim 36 wherein the cutter comprises a serated blade.

38. The machine as claimed in claim 36 wherein the path of the cutter is an arcuate pat extending at least between a position forwardly of the forming edge on one side thereof to a position at least partly on the other side of the forming edge.

39. The machine as claimed in claim 36 wherein the cutter comprises a transversely extending blade which is pivotably mounted.

40. The machine as claimed in claim 39 further comprising a projection extending from the blade on the infeed side of the blade.

41. The machine as claimed in claim 40 wherein the projection is spaced from the cutting edge of the blade.

42. The machine as claimed in claim 40 wherein the projection is elongate, extending continuously for substantially the transverse length of the blade.

43. The machine as claimed in claim 36 wherein the forming edge comprises a leading edge of a plate upon which a predetermined portion of the length of foil is supported as the cut edge is folded around the forming edge.

44. The machine as claimed in claim 36 wherein one of the infeed rollers has a compressible covering.

45. The machine as claimed in claim 44 wherein the other of the infeed rollers has grooves for forming one or more embossments along the length of foil.

46. The machine as claimed in claim 45 wherein the other roller has circumferential ridges or grooves to form stiffening grooves or ridges in the foil.

47. The machine as claimed in claim 36 wherein the infeed rollers and the outfeed rollers are adapted to dwell for a predetermined dwell period when the foil reaches the cutting/folding station.

48. The machine as claimed in claim 47 wherein the dwell period is sufficiently long to enable the cutting and folding to be performed.

49. The machine as claimed in claim 47 further including a driver which is operably connected to the infeed rollers and the outfeed rollers by a drive mechanism wherein the drive mechanism is such that the drive is temporarily suspended for the dwell period causing the infeed rollers and the outfeed rollers to dwell for the predetermined time.

50. The machine as claimed in claim 49 wherein the drive mechanism incorporates a cam.

51. The machine as claimed in claim 49 wherein the drive mechanism includes two frictionally engaging cylindrical surfaces, one of which is discontinuous so as to cause interruption of the drive to the other cylindrical surface.

52. The machine as claimed in claim 51 wherein both of the cylindrical surfaces are external surfaces.

53. The machine as claimed in claim 51 wherein a first one of the cylindrical surfaces is external and the second one is formed internally of a wheel having an outer rim which is discontinuous.

54. The machine as claimed in claim 49 wherein the driver is operably connected to the cutter.

55. The machine as claimed in claim 36 further including a driver having at least one rotating member, wherein one of the rotating members is provided with a first projection co-operable with the cutter such that with each rotation of the rotating member, the cutter is actuated.

56. The machine as claimed in claim 55 wherein the cutter is pivoted to effect a cutting stroke and the driver incorporates a crank arm having said first projection and the cutter has a pivotable actuator having a second projection which is engaged by the first projection during a predetermined portion of the rotational path of the crank arm to actuate the actuator and pivot the cutting means.

57. The machine as claimed in claim 56 wherein the cutter is biased to return after the cutting stroke.

58. The machine as claimed in claim 49 wherein the driver includes a motor.

59. The machine as claimed in claim 49 wherein the driver includes a manually operable crank handle.

60. The machine as claimed in claim 49 wherein the pair of outfeed rollers are downstream of the cutting/folding station and wherein the outfeed rollers are driven at a faster rate than the infeed rollers.

61. The machine as claimed in claim 36 wherein one of the outfeed rollers has a compressible covering.

* * * * *